US009103553B2

(12) United States Patent
Daughtridge, Jr. et al.

(10) Patent No.: US 9,103,553 B2
(45) Date of Patent: Aug. 11, 2015

(54) DOMESTIC COOKING APPLIANCE WITH ADJUSTABLE GAS SWITCH MOUNTING SYSTEM

(71) Applicant: BSH Home Appliances Corporation, Irvine, CA (US)

(72) Inventors: Charles Daughtridge, Jr., New Bern, NC (US); Tiffany E. Ingersoll, New Bern, NC (US); Benjamin Knight, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 471 days.

(21) Appl. No.: 13/705,234

(22) Filed: Dec. 5, 2012

(65) Prior Publication Data

US 2014/0150773 A1 Jun. 5, 2014

(51) Int. Cl.
*F24C 3/00* (2006.01)
*F24C 3/12* (2006.01)

(52) U.S. Cl.
CPC ..... *F24C 3/126* (2013.01); *F24C 3/124* (2013.01); *F24C 3/12* (2013.01); *F24C 3/122* (2013.01); *F24C 3/128* (2013.01)

(58) Field of Classification Search
CPC ..... F24C 3/12; F24C 3/122; F24C 3/124; F24C 3/126; F24C 3/128
USPC ..... 126/39 E
See application file for complete search history.

(56) References Cited

U.S. PATENT DOCUMENTS

| | | | | |
|---|---|---|---|---|
| 2006/0054159 | A1* | 3/2006 | Lin | 126/39 N |
| 2007/0044786 | A1* | 3/2007 | Frost et al. | 126/39 N |
| 2010/0264344 | A1* | 10/2010 | Shaffer et al. | 251/213 |
| 2011/0277742 | A1* | 11/2011 | Freeman et al. | 126/39 N |

* cited by examiner

*Primary Examiner* — Kenneth Rinehart
*Assistant Examiner* — Gajanan M Prabhu
(74) *Attorney, Agent, or Firm* — James E. Howard; Andre Pallapies

(57) ABSTRACT

A domestic cooking appliance having a gas burner and a control panel assembly is provided. The assembly includes a control panel cover; a gas switch for regulating an amount of gas delivered to the gas burner; and a mounting bracket having a front section that contacts a back side of the control panel cover, a set back section that contacts the front side of the gas switch, a top section that contacts the top of the gas switch, a bottom section that contacts the bottom of the gas switch, and a tab that extends from the top section of the mounting bracket and is attached to the top section of the mounting bracket such that it is bendable from an installation position to a switch-retaining position. The tab presses against the back side of the gas switch when the tab is in the switch-retaining position.

20 Claims, 3 Drawing Sheets

DOMESTIC COOKING APPLIANCE WITH ADJUSTABLE GAS SWITCH MOUNTING SYSTEM

FIELD OF THE INVENTION

The invention is directed to a domestic cooking appliance having a mounting system for gas switches on the domestic cooking appliance.

An example of an application for the invention is a domestic cooktop or domestic range having gas flow control switches and a mounting arrangement for the gas flow control switches on the domestic cooktop or domestic range.

BACKGROUND OF THE INVENTION

Some domestic cooking appliances have a control panel, usually at the front of the appliance, that includes one or more displays and one or more control knobs. Examples of such domestic cooking appliances include cooktops and ranges, or ovens. In the case of domestic cooking appliances that use a gas as the fuel for heating, rotary control knobs are usually used to control the amount of gas that is fed to a burner and, as a result, the amount of heat produced by the burner. These control knobs are usually attached to a rotating shaft that is part of a gas switch or gas valve located behind a decorative control panel cover.

The decorative control panel cover can include markings or other indicia that must align precisely with the control knob in order to provide a quality appearance. This precise alignment can be difficult to achieve depending on the various mounting and attachment structures used for the control panel cover, gas switches, and other parts in the area of the control panel. In some situations, it is advantageous to have an attachment mechanism that allows easy adjustment and alignment.

In light of the above, there is a need for a system that quickly, easily, and precisely locates a gas switch or unit of gas switches relative to holes in a control panel or control panel cover.

SUMMARY

The invention achieves the benefit of providing a simple and cost effective system for precisely and adjustably locating a gas switch or unit of gas switches relative to a control panel or control panel cover. In this description, the terms "control panel cover" and "control panel" are used interchangeably to indicate either a control panel or a control panel cover. The use of either one of the terms is understood to mean both situations. The term "gas switch" as used in this application can refer to a gas switch, a gas valve, or a combination of a gas switch and a gas valve.

Particular embodiments of the invention are directed to a domestic cooking appliance. The domestic cooking appliance includes a gas burner; and a control panel assembly having a control panel cover having a face, an opening in the face, and a hole in the face; a first gas switch that regulates an amount of gas delivered to the gas burner of the domestic cooking appliance, the first gas switch having a body that has a front side, a back side opposite the front side, a top, and a bottom, and a protruding portion that extends from the front side and through the opening in the control panel cover when the control panel assembly is in an assembled position; and a first mounting bracket having a front section that contacts a back side of the control panel cover, the front section having a hole, a set back section that contacts the front side of the first gas switch, the set back section having a hole through which the protruding portion of the first gas switch passes, a top section that contacts the top of the first gas switch, a bottom section that contacts the bottom of the first gas switch, and a tab that extends from the top section of the first mounting bracket and is attached to the top section of the first mounting bracket such that it is bendable from an installation position to a switch-retaining position. The tab presses against the back side of the first gas switch when the tab is in the switch-retaining position. In this way, the invention provides a simple and inexpensive way to securely hold the gas switch relative to the hole in the front section of the mounting bracket while also providing simple adjustment of the gas switch relative to the control panel cover.

Other embodiments of the invention are directed to a control panel assembly for a gas domestic cooking appliance having a gas burner. The assembly includes a control panel cover having a face, an opening in the face, and a hole in the face; a first gas switch for regulating an amount of gas delivered to the gas burner of the domestic cooking appliance, the first gas switch having a body that has a front side, a back side opposite the front side, a top, and a bottom, and a protruding portion that extends from the front side and through the opening in the control panel cover when the control panel assembly is in an assembled position; and a first mounting bracket having a front section that contacts a back side of the control panel cover, the front section having a hole, a set back section that contacts the front side of the first gas switch, the set back section having a hole through which the protruding portion of the first gas switch passes, a top section that contacts the top of the first gas switch, a bottom section that contacts the bottom of the first gas switch, and a tab that extends from the top section of the first mounting bracket and is attached to the top section of the first mounting bracket such that it is bendable from an installation position to a switch-retaining position. The tab presses against the back side of the first gas switch when the tab is in the switch-retaining position. In this way, the invention provides a simple and inexpensive way to securely hold the gas switch relative to the hole in the front section of the mounting bracket while also providing simple adjustment of the gas switch relative to the control panel cover.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Some domestic kitchens include a cooktop or range having gas burners for use in heating food in pans or other containers. Gas flow to the burners can be controlled by gas switches that include a valve controlled by a rotating knob shaft. These types of controls often protrude through a control panel cover and have attached to them a knob that is turned by a user to set the desired flow rate of the gas, which, in turn, determines the height of the flame used for heating.

Figure 1:
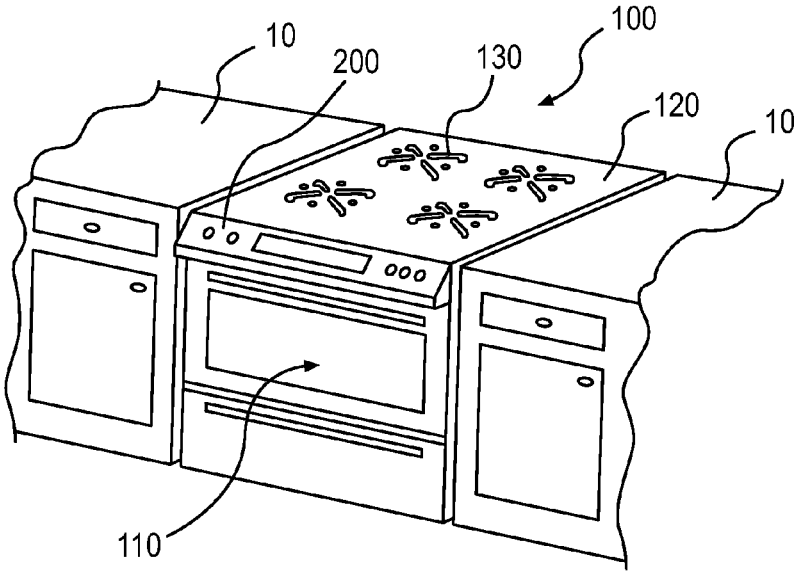
FIG. 1 is a perspective view of an example of a domestic cooking appliance in accordance with exemplary embodiments of the invention.

FIG. 1 shows an example of a range 100 that has a cooktop 120 including, in this case, four burners 130. Range 100 also has a door 110 that allows access to an oven area. In this example, range 100 is located between two cabinets 10, but other types of installations exist, such as, for example, a cooktop built into a countertop with no oven below it. The exemplary range 100 shown in FIG. 1 has a control panel cover 200 that includes various displays and controls to be used by a user of the range.

Figure 2:
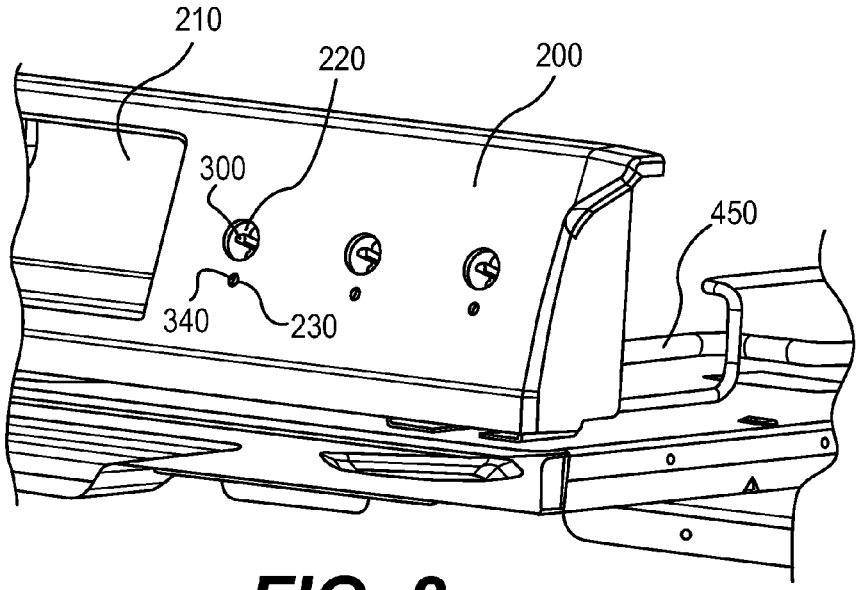
FIG. 2 is a partial perspective view of an example of a cooking appliance in accordance with exemplary embodiments of the invention.
Figure 3:
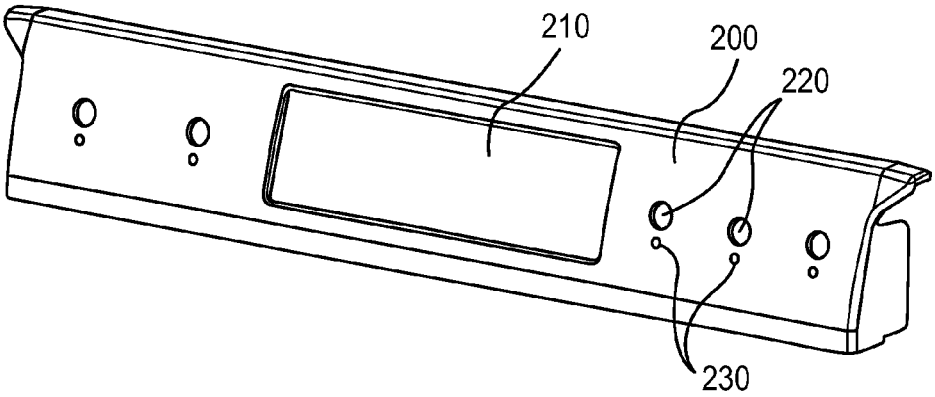
FIG. 3 is a perspective view of an example of a control panel cover in accordance with exemplary embodiments of the invention.

FIG. 2 shows a partial view of control panel cover 200 with parts of the cooktop and range removed. As shown in FIG. 2, control panel cover 200 has an opening 210 through which a display can be seen. The display can show various information including, for example, temperature, time, and other information. This view of control panel cover 200 shows three holes 220 through which the knob shafts of gas switches 300 protrude. Also shown in FIG. 2 is a gas line 450 that supplies gas to a gas manifold (described below) that in turn supplies the gas to gas switches 300. Below each hole 220 is a hole 230 that receives a fastener 340, for example a screw, that attaches gas switch 300 (by way of a mounting bracket) to control panel cover 200. FIG. 3 shows a full view of the example of control panel cover 200 shown in FIG. 2. The example of control panel cover 200 shown in FIG. 3 has five holes 220, however, control panel covers in accordance with the invention can have fewer or more holes 220.

Figure 4:
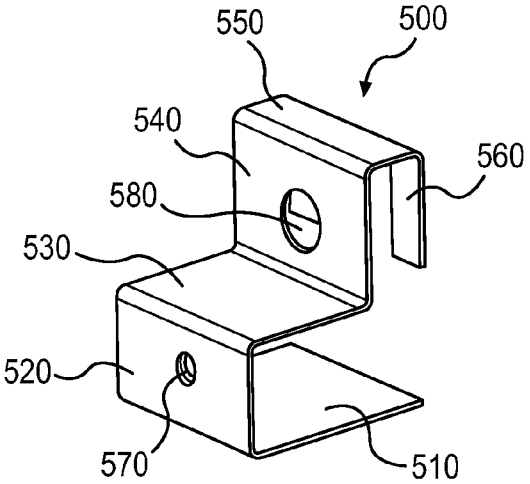
FIG. 4 is a perspective view of an example of a gas switch mounting bracket in accordance with exemplary embodiments of the invention.
Figure 5:
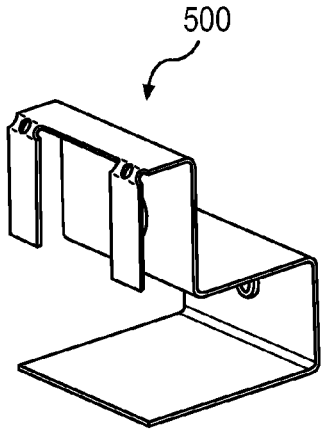
FIG. 5 is a perspective view of an example of a gas switch mounting bracket in accordance with exemplary embodiments of the invention.

FIGS. 4 and 5 show an example of a mounting bracket 500 in accordance with an embodiment of the invention. Mounting bracket 500 has a bottom section 510, a front section 520, a setback section 540, a portion 530 attaching setback section 540 to front section 520, a top section 550, and two tabs 560. The shape of mounting bracket 500 is determined by the shape of the body 310 of gas switch 300 (shown in FIG. 6) and the desired distance at which gas switch 300 is to be set back from control panel cover 200. A hole 570 in front section 520 of mounting bracket 500 is for receiving a fastener that fastens mounting bracket 500 to control panel cover 200. Setback section 540 of mounting bracket 500 includes a hole 580 through which a protruding portion (such as a knob shaft) of gas switch 300 extends. Mounting bracket 500 holds gas switch 300 in a fixed position relative to mounting bracket 500 by way of, for example, a friction fit, locating features, or other methods.

Figure 6:
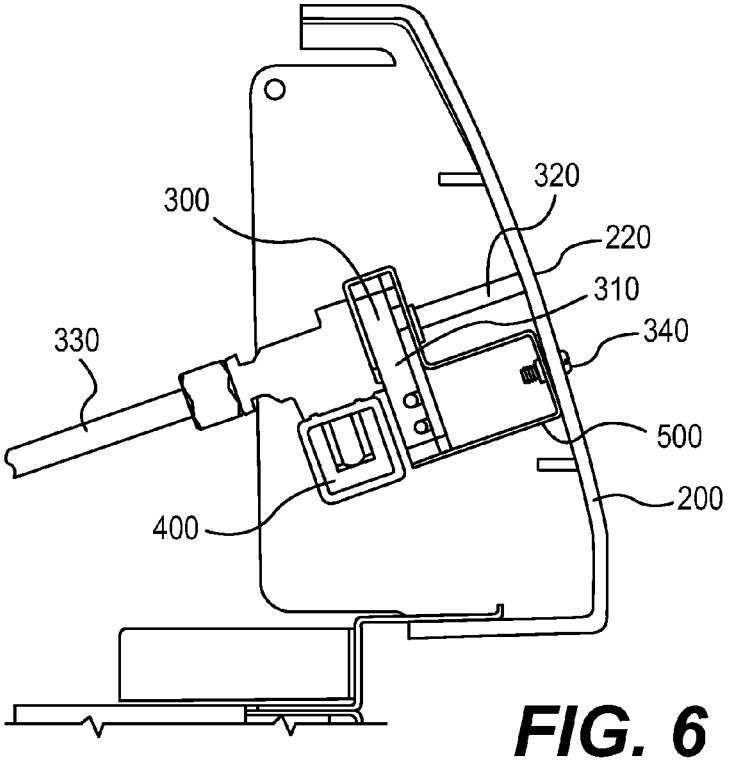
FIG. 6 is a partial side sectional view of an exemplary embodiment of the invention.

FIG. 6 shows an example of gas switch 300 mounted to control panel cover 200 by way of mounting bracket 500. In this example, gas switch 300 has a body 310 and a protruding portion, in this case a shaft, 320. Shaft 320 can be, for example, a rotating shaft that receives a knob for controlling gas flow. A gas line 330 extends from the back of gas switch 300 and leads to the burner which is controlled by gas switch 300. In the example shown in FIG. 6, gas switch 300 is fixed to a gas manifold 400 from which it receives the supply of gas.

As can be seen from FIG. 6, mounting bracket 500 holds gas switch 300 by way of bottom section 510, setback section 540, top section 550, and tabs 560. Body 310 of gas switch 300 is supported underneath by bottom section 510 of mounting bracket 500. Body 310 of gas switch 300 is held firmly between setback section 540 on its front side and tabs 560 on its backside. Tabs 560 are attached to top portion 550 by weakened sections (shown in FIG. 5) so that during assembly mounting bracket 500 can slide onto body 310 with shaft 320 projecting through hole 580 until the front of body 310 contacts the backside of setback section 540. At this point, tabs 560 extend in line with top section 550. After body 310 is in place, tabs 560 are bent down tightly against the backside of body 310 holding body 310 firmly in place.

After gas switch 300 is secured in mounting bracket 500, mounting bracket 500 is attached to control panel cover 200 by way of a faster (in this example, a screw). As explained above, due to manufacturing tolerances, shaft 320 may need to be adjusted relative to hole 220 so that shaft 320 is centered in hole 220 (or positioned in some other desired position). Hole 230 in control panel cover 200 can be larger than the portion of faster 340 that extends through hole 230 so that the position of mounting bracket 500 relative to control panel cover 200 can be adjusted. Once mounting bracket 500 and, as a result, shaft 320 are in the desired position, fastener 340 can be tightened to secure mounting bracket 500 to control panel cover 200.

Figure 7:
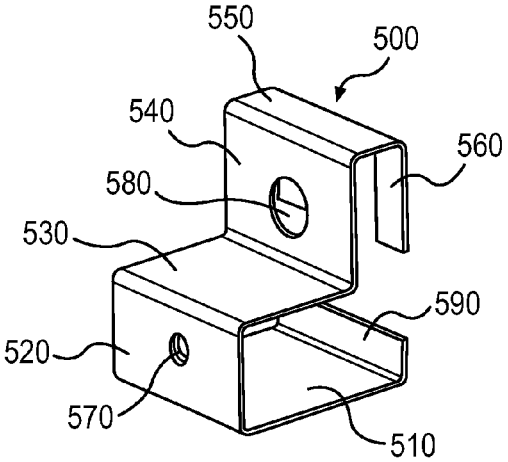
FIG. 7 is a perspective view of an example of a gas switch mounting bracket in accordance with exemplary embodiments of the invention.
Figure 8:
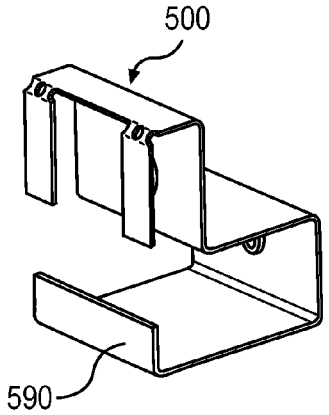
FIG. 8 is a perspective view of an example of a gas switch mounting bracket in accordance with exemplary embodiments of the invention.

FIGS. 7 and 8 show an alternate embodiment of mounting bracket 500. In this embodiment, an additional section 590 extends from bottom section 510. Section 590 provides additional support for body 310 of gas switch 300 and helps maintain the proper position of body 310. Depending on the particular configuration of gas switch 300, section 590 may need to be bent into position after gas switch 300 is placed in mounting bracket 500.

The above-described embodiments provide adjustability of gas switch 300 relative to control panel cover 200 so that a knob, or other feature, of gas switch 300 can be precisely aligned with printing or other indicia on the face of control panel cover 200. This precise alignment can be important for the proper control of gas flow and also portrays a high quality product. Mounting bracket 500 can be used on all gas switches on a cooktop, or less than all gas switches on a cooktop. The example of control panel cover 200 shown in the drawings has five holes 220 for five gas switches. In such an arrangement, it may be sufficient to provide mounting brackets 500 at only two or three of the gas switches. This can particularly be the case when all gas switches are positionally fixed relative to each other by way of, for example, a gas manifold.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A domestic cooking appliance, comprising:

a gas burner; and a control panel assembly having a control panel cover having a face, an opening in the face, and a hole in the face;

a first gas switch that regulates an amount of gas delivered to the gas burner of the domestic cooking appliance, the first gas switch having a body that has a front side, a back side opposite the front side, a top, and a bottom, and a protruding portion that extends from the front side and through the opening in the control panel cover when the control panel assembly is in an assembled position; and a first mounting bracket having a front section that contacts a back side of the control panel cover, the front section having a hole, a set back section that contacts the front side of the first gas switch, the set back section having a hole through which the protruding portion of the first gas switch passes, a top section that contacts the top of the first gas switch, a bottom section that contacts the bottom of the first gas switch, and a tab that extends from the top section of the first mounting bracket and is attached to the top section of the first mounting bracket such that it is bendable from an installation position to a switch-retaining position, wherein the tab presses against the back side of the first gas switch when the tab is in the switch-retaining position.

2. The domestic cooking appliance of claim 1, further comprising a fastener that extends through the hole in the face of the control panel cover and through the hole in the front section of the first mounting bracket such that the fastener attaches the first mounting bracket to the control panel cover, wherein the fastener and the first mounting bracket are movable in a direction parallel to the face of the control panel cover when the fastener is in the hole in the control panel cover and the fastener is in a non-tightened position, and the fastener and the first mounting bracket are fixed relative to the face of the control panel cover when the fastener is in a tightened position.

3. The domestic cooking appliance of claim 2, wherein the protruding portion is a rotary shaft of the first gas switch.

4. The domestic cooking appliance of claim 3, wherein the first gas switch is a gas valve.

5. The domestic cooking appliance of claim 2, further comprising a gas delivery manifold for delivering gas to the first gas switch, the first gas switch being fixed to the gas delivery manifold and positionally fixed relative to the gas delivery manifold.

6. The domestic cooking appliance of claim 2, wherein the first mounting bracket further comprises a retaining portion that extends from the bottom section and contacts the back side of the body of the first gas switch.

7. The domestic cooking appliance of claim 2, further comprising a second gas switch that regulates an amount of gas delivered to a second gas burner of the domestic cooking appliance, the second gas switch having a body that has a front side, a back side opposite the front side, a top, and a bottom, and a protruding portion that extends from the front side and through a second opening in the control panel cover when the control panel assembly is in the assembled position; and a second mounting bracket having a front section that contacts a back side of the control panel cover, the front section having a hole, a set back section that contacts the front side of the second gas switch, the set back section having a hole through which the protruding portion of the second gas switch passes, a top section that contacts the top of the second gas switch, a bottom section that contacts the bottom of the second gas switch, and a tab that extends from the top section of the second mounting bracket and is attached to the top section of the second mounting bracket such that it is bendable from an installation position to a switch-retaining position, wherein the tab of the second mounting bracket presses against the back side of the second gas switch when the tab of the second mounting bracket is in the switch-retaining position.

8. The domestic cooking appliance of claim 7, further comprising a second fastener that extends through a second hole in the face of the control panel cover and through the hole in the front section of the second mounting bracket such that the second fastener attaches the second mounting bracket to the control panel cover, wherein the second fastener and the second mounting bracket are movable in a direction parallel to the face of the control panel cover when the second fastener is in the second hole in the control panel cover and the second fastener is in a non-tightened position, and the second fastener and the second mounting bracket are fixed relative to the face of the control panel cover when the second fastener is in a tightened position.

9. The domestic cooking appliance of claim 8, wherein the second mounting bracket further comprises a retaining portion that extends from the bottom section of the second mounting bracket and contacts the back side of the body of the second gas switch.

10. The domestic cooking appliance of claim 2, wherein the hole in the control panel cover is larger than a cross sectional area of the fastener at a portion of the fastener that is in the hole in the control panel cover when the fastener is in the tightened position.

11. A control panel assembly for a gas domestic cooking appliance having a gas burner, the assembly comprising:

a control panel cover having a face, an opening in the face, and a hole in the face;

a first gas switch for regulating an amount of gas delivered to the gas burner of the domestic cooking appliance, the first gas switch having a body that has a front side, a back side opposite the front side, a top, and a bottom, and a protruding portion that extends from the front side and through the opening in the control panel cover when the control panel assembly is in an assembled position; and a first mounting bracket having a front section that contacts a back side of the control panel cover, the front section having a hole, a set back section that contacts the front side of the first gas switch, the set back section having a hole through which the protruding portion of the first gas switch passes, a top section that contacts the top of the first gas switch, a bottom section that contacts the bottom of the first gas switch, and a tab that extends from the top section of the first mounting bracket and is attached to the top section of the first mounting bracket such that it is bendable from an installation position to a switch-retaining position, wherein the tab presses against the back side of the first gas switch when the tab is in the switch-retaining position.

12. The assembly of claim 11, further comprising a fastener that extends through the hole in the face of the control panel cover and through the hole in the front section of the first mounting bracket such that the fastener attaches the first mounting bracket to the control panel cover, wherein the fastener and the first mounting bracket are movable in a direction parallel to the face of the control panel cover when the fastener is in the hole in the control panel cover and the fastener is in a non-tightened position, and the fastener and the first mounting bracket are fixed relative to the face of the control panel cover when the fastener is in a tightened position.

13. The assembly of claim 12, wherein the protruding portion is a rotary shaft of the first gas switch.

14. The assembly of claim 13, wherein the first gas switch is a gas valve.

15. The assembly of claim 12, further comprising a gas delivery manifold for delivering gas to the first gas switch, the first gas switch being fixed to the gas delivery manifold and positionally fixed relative to the gas delivery manifold.

16. The assembly of claim 12, wherein the first mounting bracket further comprises a retaining portion that extends from the bottom section and contacts the back side of the body of the first gas switch.

17. The assembly of claim 12, further comprising a second gas switch for regulating an amount of gas delivered to a second gas burner of the domestic cooking appliance, the second gas switch having a body that has a front side, a back side opposite the front side, a top, and a bottom, and a protruding portion that extends from the front side and through a second opening in the control panel cover when the control panel assembly is in the assembled position; and a second mounting bracket having a front section that contacts a back side of the control panel cover, the front section having a hole, a set back section that contacts the front side of the second gas switch, the set back section having a hole through which the protruding portion of the second gas switch passes, a top section that contacts the top of the second gas switch, a bottom section that contacts the bottom of the second gas switch, and a tab that extends from the top section of the second mounting bracket and is attached to the top section of the second mounting bracket such that it is bendable from an installation position to a switch-retaining position, wherein the tab of the second mounting bracket presses against the back side of the second gas switch when the tab of the second mounting bracket is in the switch-retaining position.

18. The assembly of claim 17, further comprising a second fastener that extends through a second hole in the face of the control panel cover and through the hole in the front section of the second mounting bracket such that the second fastener attaches the second mounting bracket to the control panel cover, wherein the second fastener and the second mounting bracket are movable in a direction parallel to the face of the control panel cover when the second fastener is in the second hole in the control panel cover and the second fastener is in a non-tightened position, and the second fastener and the second mounting bracket are fixed relative to the face of the control panel cover when the second fastener is in a tightened position.

19. The assembly of claim 18, wherein the second mounting bracket further comprises a retaining portion that extends from the bottom section of the second mounting bracket and contacts the back side of the body of the second gas switch.

20. The assembly of claim 12, wherein the hole in the control panel cover is larger than a cross sectional area of the fastener at a portion of the fastener that is in the hole in the control panel cover when the fastener is in the tightened position.

* * * * *